United States Patent [19]

Mattsson

[11] 4,294,554

[45] Oct. 13, 1981

[54] DRIVING DEVICE FOR A PRINTING CARRIAGE PROVIDED WITH A PRINT HEAD

[75] Inventor: Mats E. Mattsson, Sollentuna, Sweden

[73] Assignee: Svenska Kassaregister AB, Solna, Sweden

[21] Appl. No.: 41,726

[22] Filed: May 23, 1979

[30] Foreign Application Priority Data

Jun. 6, 1978 [SE] Sweden ..... 7806627

[51] Int. Cl.[3] ..... B41J 19/00

[52] U.S. Cl. ..... 400/320; 400/322; 400/323; 400/335; 101/93.15; 74/30

[58] Field of Search ..... 400/320, 322, 323, 335; 101/93.15; 346/139 R, 165; 74/30

[56] References Cited

U.S. PATENT DOCUMENTS 1,025,796 5/1912 Feidt ..... 74/30
3,826,915 7/1974 Giolitti et al. ..... 346/165
4,112,840 9/1978 Englund ..... 400/323 X

FOREIGN PATENT DOCUMENTS 7507468 2/1977 Sweden .

*Primary Examiner*—Ernest T. Wright, Jr.
*Attorney, Agent, or Firm*—Christel, Bean & Linihan

[57] ABSTRACT

A driving device for a printing carriage (20) with print head (22) including printing elements (24) which print characters on a data carrier includes a motion converting means (14) with a closed gear path (16) converting the rotational movement of a motor driven pinion (10) to a reciprocating movement of the printing carriage along the data carrier. Two pivotable gear segments (26, 28) which are in engagement with each other and with the motion converting means move the printing carriage in any of two directions parallel with the data carrier when the pinion is in engagement with any one of two straight gear paths (16*a*) on the motion converting means and permit the displacement of the motion converting means perpendicularly to said directions when the pinion is in engagement with any one of two curved gear paths (16*b*) which connect said straight paths (16*a*) on the motion converting means.

1 Claim, 3 Drawing Figures

DRIVING DEVICE FOR A PRINTING CARRIAGE PROVIDED WITH A PRINT HEAD

Figure 1:
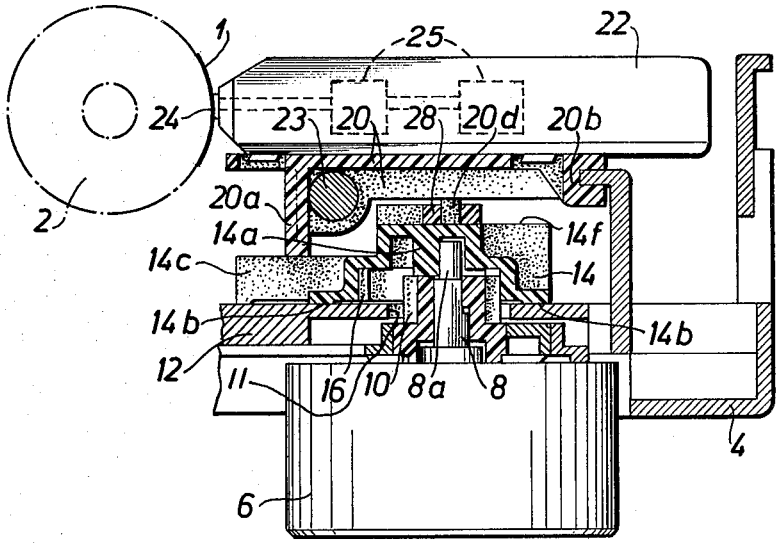

The present invention refers to a driving device for a printing carriage with a print head which has printing elements actuable to print characters on a data carrier, the driving device comprising a motion converting means and a pinion rotatably driven by a motor, the pinion being continually in engagement with an inner continuous gear path on the motion converting means. The gear path consists of two opposed essentially straight first paths, which are located at a distance from each other greater than the outer diameter of the pinion and two second paths connecting said first paths and located at a distance from each other essentially exceeding the distance between the first paths. The motion converting means converts the rotary movement of the pinion to a reciprocating movement of the print head along the data carrier.

Driving devices as described above are previously known, for instance through U.S. Pat. No. 3,826,915 and Swedish Pat. No. 75 07468-2.

In the U.S. Pat. No. 3,826,915 there is shown a printing carriage provided with a channel including inner teeth forming a closed loop. A motor is provided with a pinion which via gears, a pivotable plate and some shaft pins, is in engagement with the loop to drive it and thus drive the print head, which is fixed to the carriage, along a platen. The greatest disadvantage with this device is that a great number of details are necessary for transferring the driving movement from the motor to the print head, which makes the device complicated and thus expensive to manufacture and maintain. Moreover, the risk of breakdown and stoppage increases.

In Swedish Pat. No. 75 07468-2 there is shown a printing carriage co-operating with a motion converting means including an inner gear path forming a closed loop. A motor is provided with a pinion engaging the loop to drive the printing carriage along the platen. In order to take up the motion component generated when the movement direction of the motion converting means is reversed, said component being directed perpendicularly to said movement direction, the motion converting means and the printing carriage have been provided with guiding means engaging each other and coupling the motion converting means and the printing carriage together for common movement along the platen, the guiding means permitting the displacement of the motion converting means perpendicularly to the platen. These guiding means include channels on the printing carriage which are perpendicular to the platen and projections on the motion converting means which are displaceable in these channels. This device is simple and inexpensive to manufacture and functions satisfactorily when the movement distance of the printing carriage is short. However, if the movement distance is long, i.e. if the gear paths of the motion converting means being parallel to the platen are long, the disadvantage will be that the projections are wedged in the channels when the movement direction of the printing carriage is reversed which may cause stoppage in the worst case. This wedging effect is similar to the effect which arises when a drawer is pushed into a chest of drawers, for instance, by applying a force to the outside of the drawer which only acts on one gable thereof. Even if there will be no stoppage the wear of the projections and/or of the walls of the channels will be considerable after a short while which has the result that the print head will not be able to take up exact positions relative to the data carrier any longer. In order to decrease the tendencies of wedging said channels and the projections can be made long. However, this has the effect that the printing carriage gets such a long extension perpendicularly to the platen that its mounting in the printing device causes problems. Moreover, the wedging effect will not be solved completely in this manner.

It is an object of the present invention to provide a driving device for a printing carriage with a printing head with which the problems with previously known driving devices are avoided and which permits the moving direction of the printing carriage to be reversed without any wedging effect or even any friction worth mentioning between or wear of the printing carriage and the motion converting means arising and without the dimensions of the printing carriage and/or the motion converting means needing to be increased.

This object is fulfilled by means of guiding means which are in engagement with each other, with the motion converting means and with the printing carriage and which move the printing carriage in the printing direction when the pinion connected to the motor is in engagement with any of the first gear paths of the motion converting means, the guiding means permitting the movement of the motion converting means essentially perpendicularly to the printing direction when the pinion is in engagement with any of the second gear paths of the motion converting means. The guiding means consist of two gear segments each one provided with two gear paths. Gear paths near each other on the gear segments are in engagement with each other and gear paths at a distance from each other on the gear segments are in engagement with gear paths on the motion converting means or on the printing carriage. The gear segments are pivotally mounted on the printing carriage or on the motion converting means.

Figure 2:
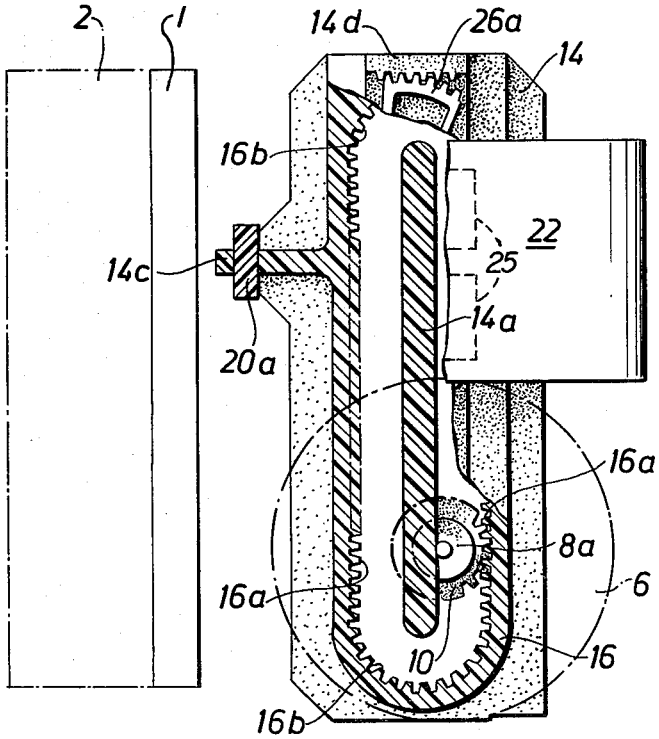
Figure 3:
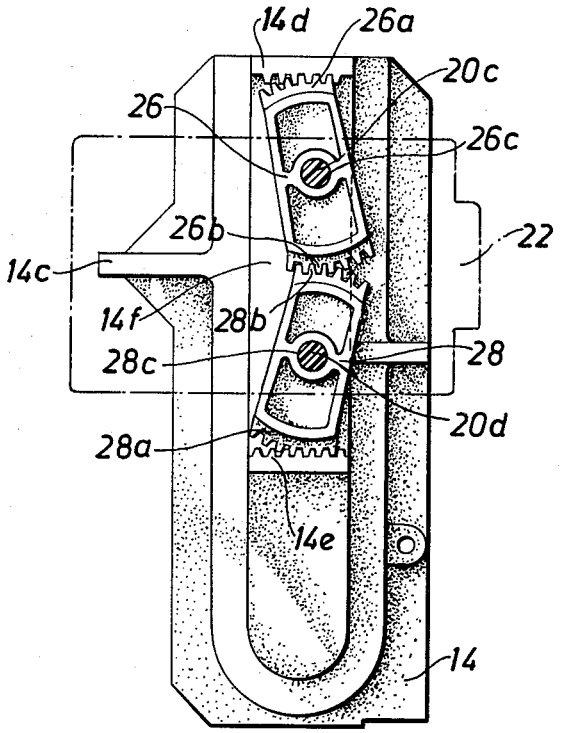

A preferred embodiment of the invention will now be described while referring to the appended drawing on which FIG. 1 is a side view partly in section of the driving device according to the invention, FIG. 2 is a view seen from above of the driving device according to FIG. 1 with certain parts cut away, and FIG. 3 is a view seen from above of the driving device according to FIGS. 1 and 2.

The printing device shown in the Figures comprises a platen 2 which extends in the printing direction and which is rotatably mounted in a frame a portion 4 of which is shown in FIG. 1. An electric motor 6 is also attached to the frame portion 4 and on its drive shaft 8 there is attached a pinion 10 in a suitable manner. The pinion 10 is introduced through a hole 11 in the bottom 12 of the frame portion 4 and engages with a motion converting means in the form of a box-shaped means 14 provided with a continuous gear path 16, and which in the following is termed "box". The gear path 16 comprises two straight paths **16*a* and two generally semicircular paths 16*b* joining the paths 16*a*. The distance between the two straight paths 16*a* is slightly larger than the outside diameter of the pinion 10, so that when the pinion 10 engages with one straight path 16*a*, the other straight path 16*a* is at a distance from the pinion 10. The length of the two straight paths 16*a* is dependent on the line length which is desired to be printed on a data carrier 1 such as a calculation strip or a receipt placed on the platen 2**.

An extension 8*a* of the shaft 8, provided with a small diameter, engages continually with a vertical wall 14*a* extending downward from the bottom of the box 14 which is turned upside-down. The wall 14*a* is centrally situated in the box 14 and extends parallel to the straight gear paths 16*a* substantially for the whole of their length. The distance between either end of the wall 14*a* and the top tooth lands of the adjacent semicircular gear path 16*b* is generally the same as the distance between the wall 14*a* and the top tooth lands of a straight gear path 16*a*, the latter distance being generally the same as the distance, perpendicular to the wall 14*a*, between the engaging surface of the shaft extension 8*a* with the wall 14*a* and the bottom tooth land of the pinion 10.

The box 14 which as a whole is manufactured from a hard plastic material is also provided with a pair of flanges 14*b* integral with the box 14, the flanges 14*b* only engaging with a portion of their lower surfaces against the upper side of the bottom 12 of the frame portion 4 so that the friction between the box 14 and the frame portion 4 will be as small as possible when the box 14 is shifted in any of four different directions.

A printing carriage 20 carrying a print head 22 consists of a plate made in hard plastic and with two downwardly directed portions one of which 20*a* having a lower end which is located above a projection 14*c* on the box 14 to prevent a possible upward displacement thereof and the other of which consists of a piece 20*b* partly surrounding the frame portion 4. The carriage 20 is kept at a pre-determined constant distance from the platen 2 partly by means of the piece 20*b* and partly by means of a shaft 23 attached to the frame portion 4. The carriage 20 is mounted for movement on the shaft 23 and on the frame portion 4 (at 20*b*) along the platen 2. The carriage 20 carries, as has been mentioned above, a print head 22 including solenoids 25 co-operating with print needles 24 which are supported in the print head 22 and which, when selected solenoids 25 are energized and the carriage takes up pre-determined positions along the platen 2, move pertaining needles 24 towards and into engagement with the data carrier 1 on the platen 2, the data carrier 1 thereby being provided with combinations of dots forming different characters. Each time the direction of movement of the box 14 along the platen 2 is reversed, i.e. when the pinion 10 goes from engagement with one straight gear path 16*a* to the other straight gear path 16*a* via one of the semi-circular paths 16*b*, the box 14 is given a sideways movement perpendicular to the platen 2 depending on two pivotable guiding elements in engagement with each other, with the box 14 and with the printing carriage 20. In the embodiment shown in the Figures the two pivotable guiding elements consist of gear segments 26 and 28 each one provided with two opposed curved gear paths 26*a*, 26*b* and 28*a*, 28*b*, respectively, (FIG. 3) the centre of curvature of each one being located centrally in the segments 26 and 28 where bearing holes 26*c* and 28*c*, respectively, have been formed. Pins 20*c* and 20*d* downwardly extending from the carriage 20 have been inserted into the holes 26*c* and 26*d* permitting the pivotal movement of the segments 26 and 28 when the gear paths 26*b* and 28*b* engage each other. The segments 26 and 28 have smooth under surfaces which contact the smooth upper surface 14*f* of the box 14 from which two straight gear paths 14*d* and 14*e*, integrally formed with the box 14 and directed towards each other, extend upwards. The gear paths 26*a* and 28*a* are in engagement with the gear paths 14*d* and 14*e*, respectively.

When the movement direction of the box 14 along the platen 2 is reversed the box 14 will be displaced perpendicularly to this direction depending on the guiding function of the segments 26 and 28. If there was no guiding of the box 14 the latter would rotate or pivot uncontrollable around any axis parallel to the shaft 8, whereby its function as a motion converting means would cease or in any case would be essentially decreased and whereby the print head 22 would take up incorrect positions relative to the platen 2. Thus, when the moving direction of the box 14 parallel to the platen 2 is reversed the gear paths 14*d* and 14*e* formed on the box 14 will be displaced in their longitudinal directions without any hinderance because the segments 26 and 28 simultaneously are rotated around the pins 20*c* and 20*d*. Independently of the position of the box 14 and of the amount of rotation of the segments 26 and 28 the segments 26 and 28 will always be in engagement with each other and with the gear paths 14*d* and 14*e*. Thus, any relative movement between the box 14 and the carriage 20 in the longitudinal direction of the platen 2 (in the printing direction) is not possible. Neither is any relative movement between the carriage 20 and the box 14 other than the perpendicular movement possible because such a movement is prevented by the permanent engagement between the gear paths 14*d* and 26*a*, 26*b* and 28*b*, 14*e* and 28*a*.

In a modification of the device according to the invention the pins 20*c* and 20*d* may be connected to the box 14 and the gear paths 14*d* and 14*e* connected to the carriage 20 whereby the same function as the one described above will be obtained.

That which has been described above and shown on the drawing does not, of course, limit the invention, which is limited only to what is stated in the claim.

I claim:

1. A driving device for a printing carriage with a print head including printing elements actuable to print characters on a data carrier, the driving device including a motion converting means and a pinion driven by a motor and always in engagement with an inner continuous gear path on the motion converting means, said gear path consisting partly of two opposed essentially straight first gear paths located at a distance from each other greater than the outer diameter of the pinion and partly of second gear paths connecting said first gear paths and located at a distance from each other essentially exceeding the distance between the first gear paths, the motion converting means converting the rotational movement of the pinion to a reciprocating movement of the print head along the data carrier, the driving device further including guiding means in engagement with each other, with the motion converting means and with the printing carriage, the guiding means moving the printing carriage in the printing direction when the pinion is in engagement with any of the first gear paths of the motion converting means and permitting the displacement of the motion converting means essentially perpendicularly to the printing direction when the pinion is in engagement with any of the second gear paths of the motion transmitting means, characterized in that the guiding means consist of two gear segments each one provided with two gear paths, that the gear paths turned towards each other on the gear segments are in engagement with each other and the gear paths turned away from each other on the gear segments are in engagement with gear paths on one of the motion converting means and the printing carriage, and that the gear segments are pivotally supported on one of the printing carriage and the motion converting means.

* * * * *